United States Patent [19]

Katoh

[11] 4,415,108

[45] Nov. 15, 1983

[54] ROLL FEED APPARATUS

[75] Inventor: Heizaburou Katoh, Tokyo, Japan

[73] Assignee: Sankyo Manufacturing Company, Ltd., Tokyo, Japan

[21] Appl. No.: 315,798

[22] Filed: Oct. 28, 1981

[30] Foreign Application Priority Data

Oct. 30, 1980 [JP] Japan ..... 55-152684

[51] Int. Cl.[3] ..... B65H 17/22

[52] U.S. Cl. ..... 226/138; 226/154; 226/176

[58] Field of Search ..... 226/120, 123, 135, 136, 226/137, 138, 139, 152, 154, 156, 176, 180; 74/112, 126

[56] References Cited

U.S. PATENT DOCUMENTS

| | | | |
|---|---|---|---|
| 3,784,075 | 1/1974 | Portmann | 226/154 X |
| 4,032,056 | 6/1977 | Ito | 226/156 X |
| 4,144,990 | 3/1979 | Johnson | 226/156 X |
| 4,304,348 | 12/1981 | Kato | 226/152 |

*Primary Examiner*—Stuart S. Levy
*Assistant Examiner*—Lloyd D. Doigan
*Attorney, Agent, or Firm*—Pollock, Vande Sande & Priddy

[57] ABSTRACT

A roll feed apparatus comprises a main roll (4) and a subroll (8) adapted to cooperate with the main roll to feed a flat workpiece (7) in a clamped state on a step-by-step basis. The main roll is mounted on an output shaft (2) of an intermittent motion mechanism (3) to be intermittently rotated in one direction. The subroll has a rotation-transmission roll (8*a*) disposed at one axial end of the subroll and is rigidly mounted on a subroll shaft (6) which is rotatably supported in a roll housing (5*a*) through an externally rotatable eccentric flange (10), and a workpiece-engaging roll (8*b*) supported by the rotation-transmission roll and surrounding the subroll shaft. The rotation-transmission roll has a peripheral surface which makes rolling contact with the main roll for transmitting rotation, and is movable toward and away from the main roll to adjust contact pressure between the main roll and the rotation-transmission roll upon rotation of the eccentric flange. The workpiece-engaging roll is rotatably supported within a roll holder which is movable, together with the workpiece-engaging roll, toward and away from the main roll to adjust the amount of nip between the main roll and the workpiece-engaging roll. See FIGS. 2–6.

17 Claims, 17 Drawing Figures

ROLL FEED APPARATUS

BACKGROUND OF THE INVENTION

1. Field of the Invention

The present invention relates to a roll feed apparatus for feeding intermittently a sheet-like blank material to a processing station on a step-by-step basis. More particularly, the invention concerns a roll feed apparatus which includes a main roll and a subroll for feeding intermittently a strip-like sheet material to one or more work stations such as metallic molds in a selective manner and which is suited to be incorporated in an automated manufacturing machines or other machine tools.

2. Description of the Prior Art

Many shortcomings have been noted in known sheet material feeding apparatus of the type described above in which a combination of a one-way clutch and a brake or a combination of a rotating cam and a cam follower is used for converting a continuous rotation input to an intermittent rotation output for driving intermittently the feeding roller. For example, it is difficult, not to say impossible, to feed a strip-like blank material stepwise by a predetermined quantity with a reasonable accuracy due to backlash in a gear train or a dimensional tolerance involved in implementing the cam and cam follower mechanism. The feeding operation may not be carried out at a high speed because jamming or deformation of the sheet material being stepwise fed will be then possibly involved. Troublesome and time consuming procedures are required for adjusting the feeding apparatus for different sheet materials having different thickness. Further, it has been impossible to vary a quantity of sheet material to be fed through a single feeding step in a continuous manner without interrupting operation of the feeding apparatus as well as associated tool or tools.

SUMMARY OF THE INVENTION

Accordingly, an object of the present invention is to provide a roll feed apparatus for feeding a workpiece or sheet material intermittently, i.e. on a step-by-step basis which is free of the difficulties and inconveniences of the hitherto known apparatus such as described above.

Another object of the invention is to provide a roll feed apparatus which is capable of feeding a strip-like sheet material intermittently by a predetermined quantity with an enhanced accuracy even in a high speed operation without involving jamming, deformation or the like undesirable phenomena.

Still another object of the invention is to provide a roll feed apparatus which can positively transmit the rotating force of a main roll to a subroll and which can easily adjust the clamping forces imparted to the sheet material from the rolls depending upon the thickness or other factors of the sheet material.

A further object of the invention is to provide a sheet material feeding apparatus of the type described, in which the quantity of sheet material to be fed through a single feeding step can be varied in a continuous manner without requiring interruption in operation of the feeding apparatus.

According to a general aspect of the invention, there is provided a roll feed apparatus of the type comprising an intermittent motion mechanism adapted to translate the continuous rotation of an input shaft into the intermittent rotation in one direction of an output shaft, a main roll rigidly fitted over the output shaft, a subroll shaft which is extended substantially in parallel with the output shaft and which is rotatably supported by a roll housing, and a subroll rigidly supported on the subroll shaft and adapted to coact with the main roll to clamp and feed a workpiece between them. In a preferred embodiment the subroll shaft is rotatably supported in the roll housing through an eccentric flange; the subroll comprises a rotation-transmission roll which is disposed at one axial end of the subroll, rigidly supported by the subroll shaft and has a cylindrical peripheral surface for rolling contact with the main roll, and a workpiece-engaging roll which is supported by the rotation-transmission roll in such a way that the workpiece-engaging roll surrounds the subroll shaft and can be moved toward or away from the main roll. The preferred embodiment also includes a first adjusting device which is operatively connected to the eccentric flange and which is adapted to rotate the eccentric flange in such a direction that the subroll shaft is caused to move toward or away from the output shaft, whereby the contact pressure between the main roll and the rotation-transmission roll can be adjusted; and a second adjusting device including a roll holder which rotatably holds the workpiece-engaging roll and which is so supported by the roll housing that the roll holder can move in unison with the workpiece-engaging roll to cause the workpiece-engaging roll to move toward or away from the main roll.

The above and other objects, novel features and advantages of the invention will become more apparent from the following description of the preferred embodiments of the invention. The description makes reference to the accompanying drawings.

DESCRIPTION OF THE PREFERRED EMBODIMENT

Figure 1:
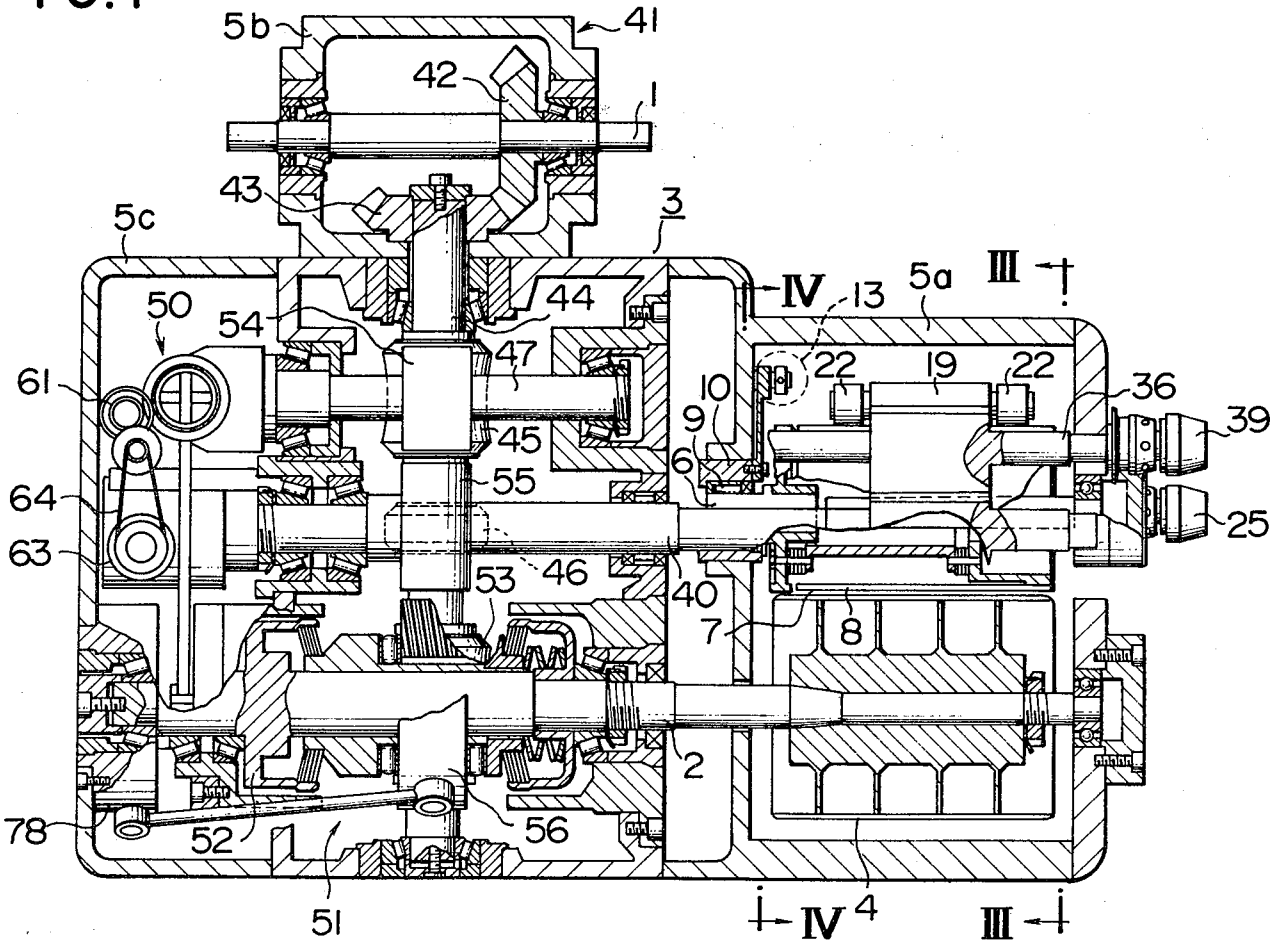
FIG. 1 is a longitudinal sectional view of a roll feed apparatus in accordance with an embodiment of the present invention.

Referring first to FIG. 1, a preferred embodiment of a roll feed apparatus in accordance with the present invention has an intermittent motion mechanism 3 having an input shaft 1 and an output shaft 2 which is driven intermittently in one direction; a main roll 4 supported securely on the output shaft 2; a subroll shaft 6 so disposed as to be substantially in parallel with the output shaft 2; and subroll 8 supported by the subroll shaft 6 and adapted to coact with the main roll 4 so as to clamp and transport a flat workpiece or plate 7.

Figure 6:
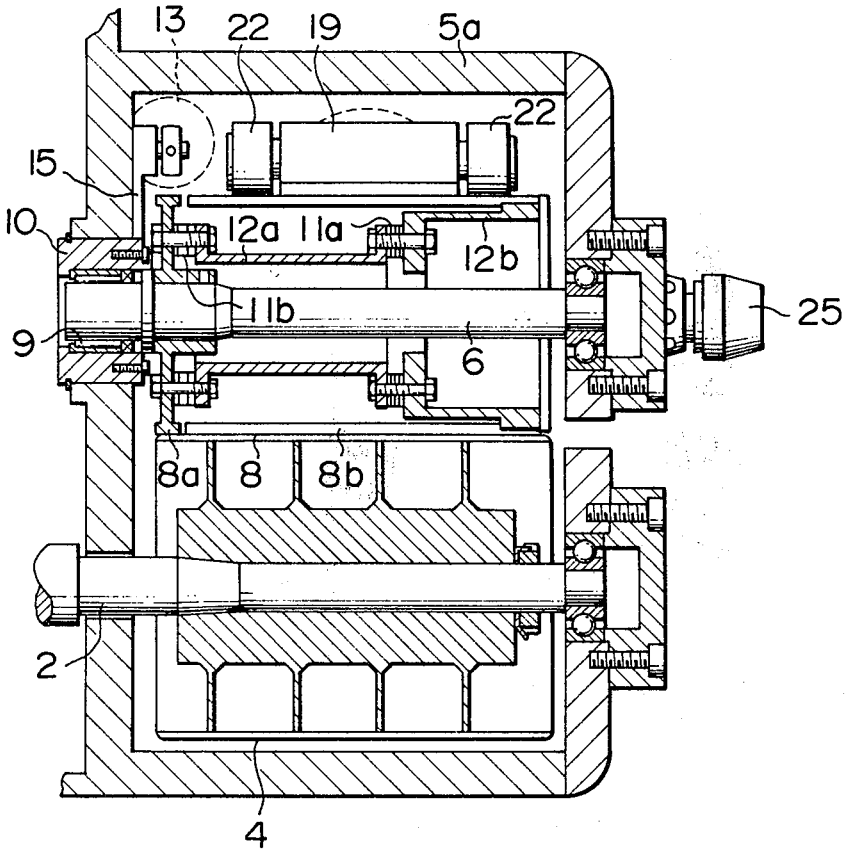
Figure 7:
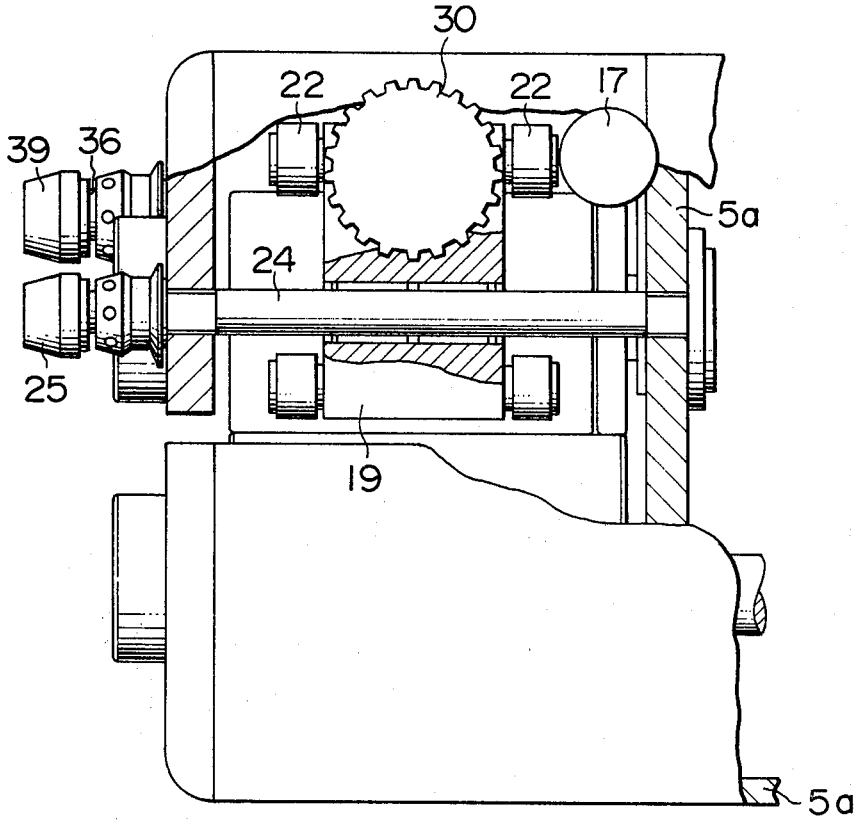

Referring further to FIGS. 1, 2, 4 and 6, the subroll shaft 6 is rotatably supported in a roll housing 5*a* through a bearing 9 and an eccentric flange 10. As best shown in FIG. 6, the subroll 8 comprises a rotation-transmission roll 8*a* and a thin-wall cylindrical plate-engagement roll 8*b*. The transmission roll 8*a* is securely mounted at its left end on the subroll shaft 6 and is adapted to make into rolling contact with the main roll 4. The engaging roll 8*b* is so disposed as to surround the subroll shaft 6. The engaging roll 8*b* is joined to a large-diameter cylinder 12*b* which in turn is connected to a small-diameter cylinder 12*a* through a flexible coupling 11*a*. The transmission roll 8*a* is joined to the small-diameter cylinder 12*a* through a flexible coupling 11*b*. The first and second flexible couplings 11*a* and 11*b* are of the conventional type and permit vertical movement of engagement roll 8*b* (See FIG. 6) toward or away from the transmission roll 8*a* and hence the main roll 4. In addition, they ensure the positive transmission of rotation between the transmission roll 8*a* and the engaging roll 8*b* even when these rollers are axially misaligned from each other.

Figure 2:
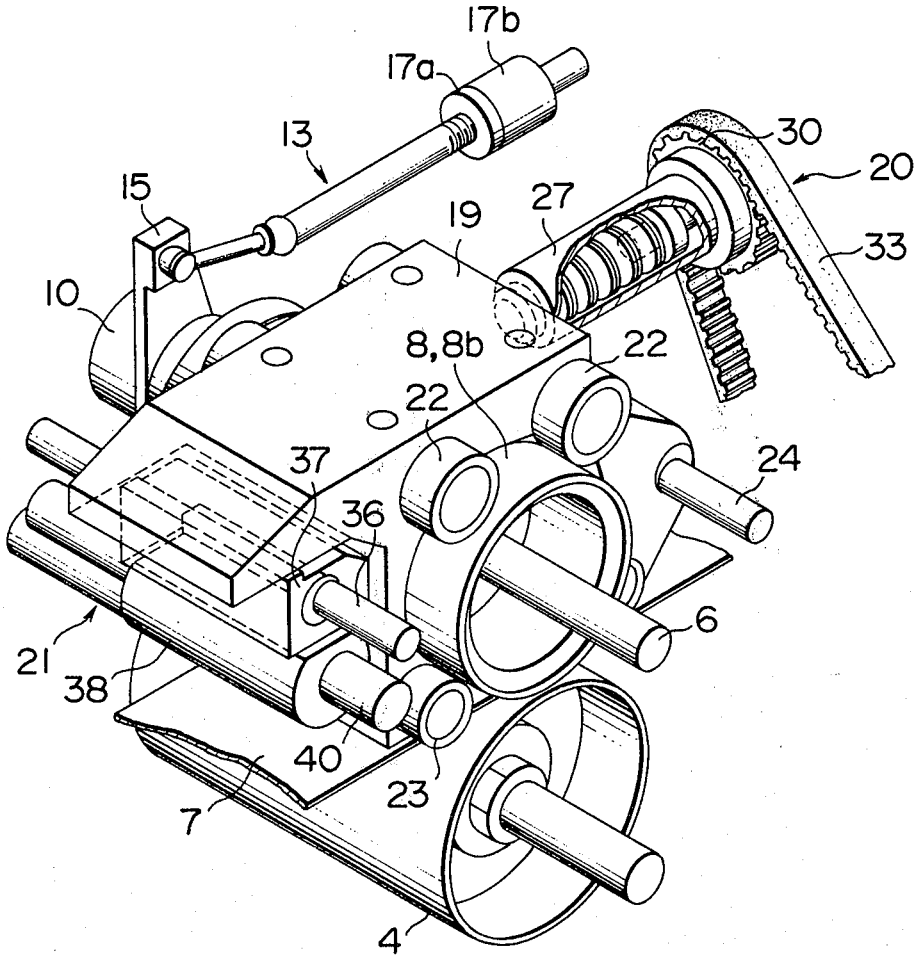
FIG. 2 is a fragmentary perspective view thereof showing a main roll and a subroll and their associated mechanism.
Figure 4:
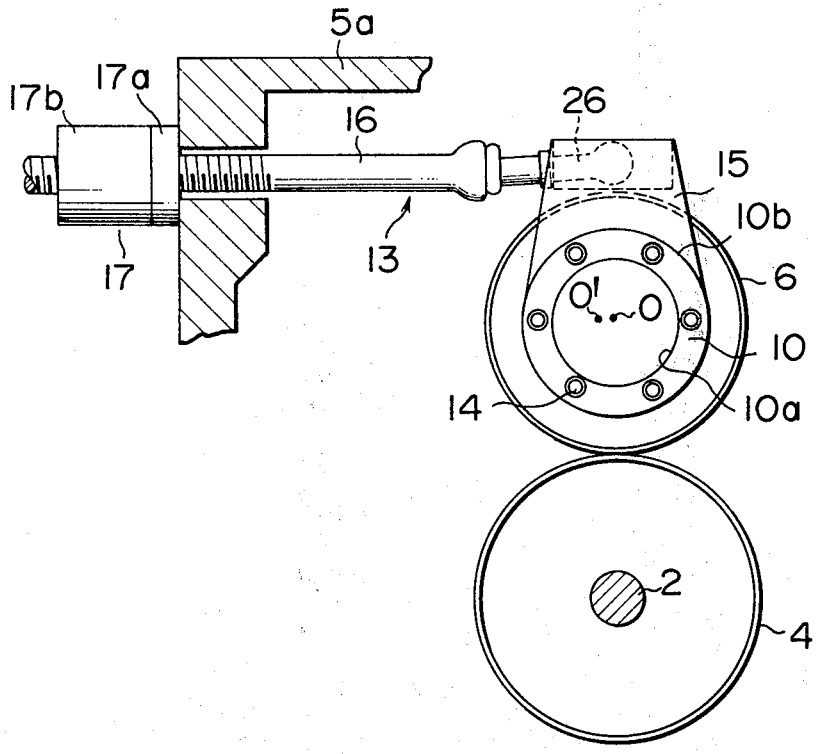
FIG. 4 is a view taken along the line IV—IV of FIG. 1.

The eccentric flange 10 is joined to a first adjustment device 13 which is best shown in FIGS. 2, 4 and 6. The first adjustment device 13 comprises an arm 15 joined with bolts 14 to the eccentric flange 10, a rod 16 which is partially externally threaded as best shown in FIG. 4 and is extended through a roll housing 5*a*, an adjusting dial 17 threadably engaged with the left end portion of the rod 16 (See FIG. 4) and a connecting rod 26 whose ball-like ends are rotatably fitted into the mating sockets or the like, respectively, of the rod 16 at its right end and of the arm 15. The adjusting dial 17 consists of a stationary member 17*a* securely joined to the roll housing 5*a* and a rotating member 17*b* detachably attached to the stationary member 17*a*. Both the stationary and rotating members 17*a* and 17*b* are threadably engaged with the rod 16 so that when the rotating member 17*b* is rotated, the rod 16 is moved to the right or left in FIG. 4. As a consequence, the arm 15 is caused to rotate or swing in the clockwise or counterclockwise direction so that the eccentric flange 10 is caused to rotate in the same direction. Upon rotation of the eccentric flange 10, the left end (See FIG. 6) of the subroll shaft 6 is moved upward or downward so that the contact pressure between the main roll 4 and the transmission roll 8*a* is varied. Thus, the contact pressure between the main roll 4 and the transmission roll 8*a* can be suitably set by rotating the rotating member 17*b*, whereby the positive transmission between these rolls can be maintained. The eccentric flange 10 is of the conventional type and is such that the axis o of the inside cylindrical surface 10*a* which is fitted over the bearing 9 and the axis o' of the outside cylindrical surface fitted into a mating hole (See FIG. 1) of the roll housing 5*a* are not aligned but are eccentric from each other as best shown in FIG. 4 so that upon rotation of the eccentric flange 10, the vertical movement of the subroll shaft 6 results as described above.

Next, referring particularly to FIGS. 1, 2, 3, 5, 6, 7 and 8, a second adjustment device 18 for moving the engaging roll 8*b* away from the main roll 4.

Figure 3:
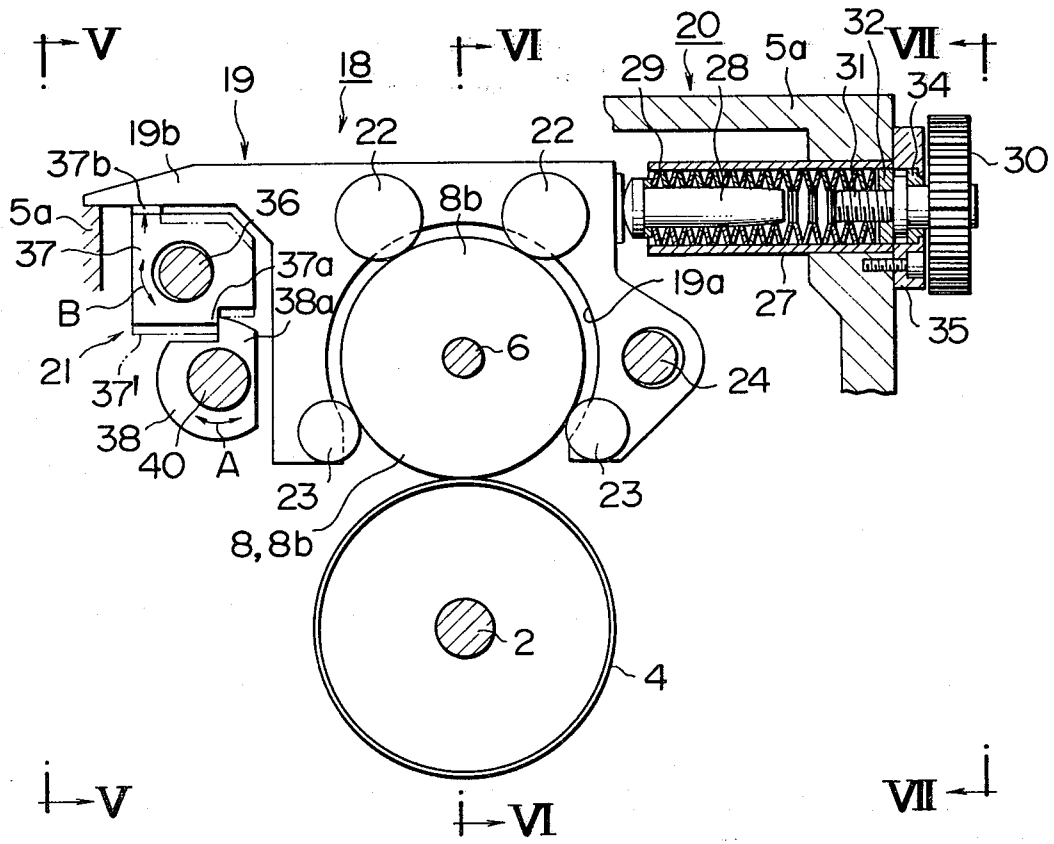
FIG. 3 is a view taken along the line III—III of FIG. 1.

As best shown in FIGS. 2 and 3, the second adjustment device 18 comprises a roll holder 19, a pressure adjusting or control device 20 and a release device 21. The roll holder 19 has a center bore 19*a* and a plurality of rolling bodies 22 and 23 are disposed around the center bore 19*a* at each end thereof as best shown in FIG. 2 and are positioned for rolling contact with the engaging roll 8*b* which is extended through the center bore 19*a*. Thus the roll holder 19 rotatably holds the engaging roll 8*b*. The right end (See FIG. 3) of the roll holder 19 is fitted over a large diameter portion 24*a* of an eccentric rod 24 (See FIG. 8); that is, the large-diameter portion 24*a* of the eccentric rod 24 is fitted into an axial hole (See FIG. 3) of the roll holder 19 extended therethrough in parallel with the center bore 19*a*. The left end; that is, a flange portion 19*b* of the roll holder 19 (See FIG. 3) is made into engagement with the roll housing 5*a*. When the plate 7 is clamped between the main roll 4 and the engaging roll 8*b*, the latter is raised to the position spaced apart upwardly by a distance equal to the thickness of the plate 7 from the position shown in FIG. 3 so that the roll holder 19 is caused to slightly rotate in the clockwise direction in FIG. 3 about the eccentric rod 24 and consequently the flange portion 19*b* is spaced apart from the roll housing 5*a*.

Figure 8:
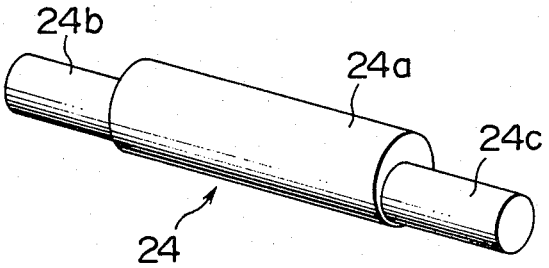
FIG. 8 is a perspective view of an eccentric rod.

As shown in FIG. 8, the axis of the large diameter portion 24*a* of the eccentric rod 24 is eccentric to the axis of small diameter end portions 24*b* and 24*c* extended from the ends, respectively, of the large diameter portion 24*a*. The small diameter portions 24*b* and 24*c* are rotatably fitted into their mating holes of the roll housing 5*a* (See FIG. 7) and one (left in FIG. 7) end of the eccentric rod 24 is extended through the housing wall 5*a* and is fitted with an adjusting dial 25 (See FIGS. 5 and 7). Upon rotation of the second adjusting dial 25, the eccentric rod 24 is caused to rotate in the counter-clockwise direction in FIG. 3 about the axis of the small-diameter portion 24*b* and 24*c* thereof so that the large diameter eccentric portion 24*a* fitted into the roll holder 19 causes the right end of the holder 19 to move upward. As a result, the engaging roll 8*b* which is held by the roll holder 19 is moved upward away from the main roll 4 so that a plate 7 can be fed between them. After the insertion of the plate 7, the second adjusting dial 25 is rotated in the opposite direction so that the right end of the roll holder 19 is lowered and consequently the engaging roll 8*b* can be moved down to a position optimum for clamping the plate 7 between the main roller 4 and the engaging roller 8*b*.

The contact pressure between the rolls 4 and 8*b* and the contact pressures exerted to the clamped plate 7 therefrom can be adjusted by the pressure adjusting or control device 20. The pressure adjusting device 20 includes a hollow cylinder 27 which is securely supported by the roll housing 5*a* (See FIG. 3) and a spring 29 disposed in the hollow cylinder 27. A pushing pin 28 is pressed against the roll holder 19 under the force of the bias spring 29 (to the left in FIG. 3) so that the roll holder 19 is forced to rotate in the counter-clockwise direction (in FIG. 3) about the eccentric rod 24. The pressure adjusting device 20 further includes a spring-force adjusting device comprising a gear or sprocket 30, a screw rod or shaft 31 one (right, in FIG. 3) end of which is securely fixed to the gear or sprocket 30 for unitary rotation therewith and which is extended through spring 29 in the hollow cylinder 27 and a screw nut 32 threadably engaged with the screw rod or shaft 31 and abutted against one or outer end (the right end in FIG. 3) of the spring 29. The nut or sprocket 30 is drivingly coupled through an endless belt 33 (See FIG. 2) to a motor (not shown) so that upon rotation of the latter, the gear or sprocket 30 and the screw rod or shaft 31 are rotated in unison. As a result, the screw nut 32 is moved along the screw rod or shaft 31 inwardly or outwardly of the hollow cylinder 27 and consequently the bias spring 29 is compressed or expanded. Thus the force of the spring 29 can be adjusted by selecting the direction of rotation of the gear or sprocket 30 and the angle of rotation thereof and consequently the pressure exerted from the spring 29 through the pushing pin 28 can be adjusted. As a result, the force which causes the roll holder 19 in the counterclockwise direction in FIG. 3 about the eccentric rod 23 can be adjusted. That is, when the roll holder 19 is rotated in the counterclockwise direction, the engaging roll **8*b* is forced downward in FIG. 3, and vice versa. Thus, the pressure exerted from the engaging roll 8*b* to the main roll 4 and hence the force for clamping the plate 7 between them can be suitably adjusted. Referring to FIG. 3, a bearing 34 securely fixed to roll housing 5*a* through a ring 35 with bolts is interposed between the roll housing 5*a* and the gear or sprocket 30**.

Figure 5:
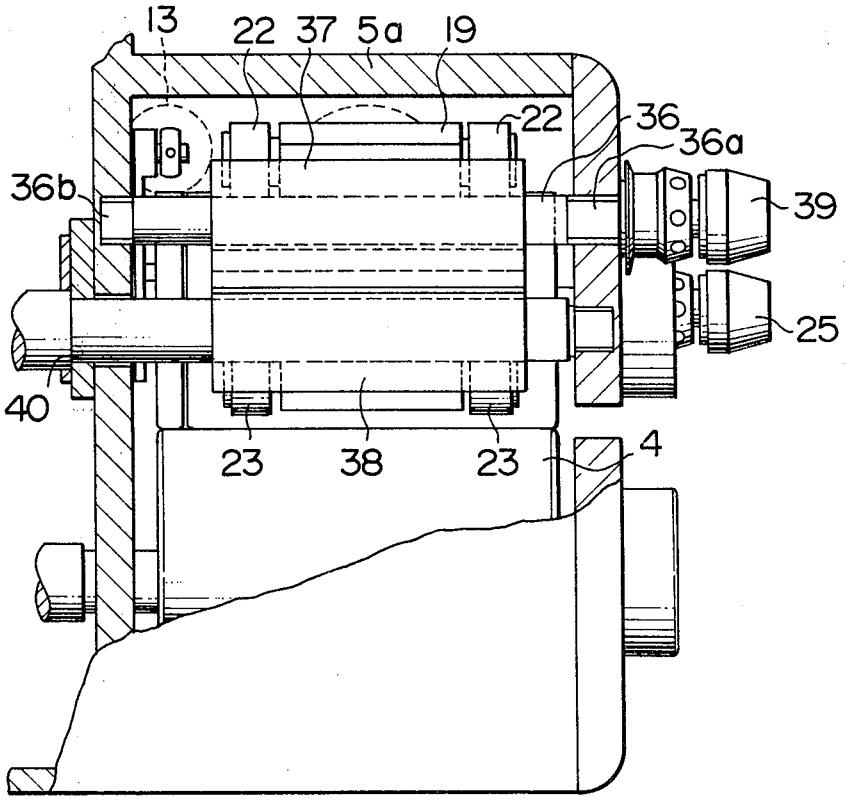
FIGS. 5–7 are views taken along the lines V—V, VI—VI and VII—VII, respectively, of FIG. 3.

Next referring particularly to FIG. 3, the release device generally indicated by the reference numeral 21 includes a first release block 37 adapted for engagement with the undersurface of the flange portion **19*b* at the left of the roll holder 19 and a second release block 38. An eccentric rod 36 which is substantially similar in construction to the eccentric rod 24 as shown in FIG. 8 is fitted into a through hole formed through the first release block 37 in such a way that the first release block 37 can rotate about the eccentric rod 36. Small-diameter portions 36*a* and 36*b* extended from the large diameter portion fitted into the first release block 37 are rotatably supported by the roll housing 5*a* as shown in FIG. 5. The small diameter portion 36*a* is extended through the roll housing wall 5*a* and fitted with an adjusting dial 39. The second release block 38 is securely fitted over a release shaft 40 of the intermittent motion mechanism 3 (See FIG. 1). As will be described in detail hereinafter, when the input shaft 1 of the intermittent motion mechanism 3 is continuously rotated, the release shaft 40 is caused to reciprocably rotate through a predetermined angle. A projection 38*a* extended from the upper portion of the second release block 38 is engaged with a stepped portion 37*a* of the first release block 37**.

When the adjusting dial 39 is rotated, the eccentric rod 36 is rotated so that the first release block 37 is caused to move upward or downward. When the release shaft 40 is reciprocably rotated, the second release block 38 is caused to swing in the directions indicated by a double-pointed arrow A in FIG. 3. When the second release block 38 is rotated in the counter-clockwise direction when the first release block 37 is located at the position as shown in FIG. 3, the projection **38*a* of the second release block 38 pushes the stepped portion 37*a* of the first release block 37 so that the latter is caused to rotate in the clockwise direction as indicated by an arrow B about the axis of the eccentric rod 36. As a result, a projection 37*b* extended from the upper portion of the first release block 37 pushes the flange portion 19*b* of the roll holder 19 so that the latter is caused to rotate in the clockwise direction in FIG. 3 about the axis of the eccentric rod 24. Therefore the engaging roll 8*b* is caused to move upward away from the main roll 4 so that the plate 7 is released from the main roll 4 and subroll 8. When the rotation of the second release block 38 is reversed to the clockwise direction, the roll holder 19 is caused to rotate in the counterclockwise direction about the eccentric rod 24 under the force exerted from the pressure adjusting evice 20 so that the flange portion 19*b* of the roll holder 19 pushes down the projection 37*b* of the first release block 37 and consequently the first release block 37 is caused to rotate in the counterclockwise direction to the initial position as shown in FIG. 3. As a consequence, the plate 7 is clamped again between the main roll 4 and the engaging roll 8*b***.

When the adjusting dial 39 is so rotated that the eccentric rod 36 is caused to rotate in the counter-clockwise direction from the position as shown in FIG. 3, the first release block 37 is caused to move downward a distance corresponding to the eccentricity of the eccentric rod 36 to the position indicated by the two-dot chain lines in FIG. 3. Therefore even when the second release block 38 is caused to rotate in the counter-clockwise direction so that the projection **38*a* pushes the stepped portion 37*a* and consequently the first release block 37 is caused to rotate in the clockwise direction, the projection 37*b* of the first release block 37 cannot engage with the flange portion 19*b* of the roll holder 19. As a consequence, the release device 21 cannot release the plate 7 clamped between the main roll 4 and the engaging roll 8*b*. In order to prevent the engagement of the projection 37*b* with the flange portion 19*b*, the relative positions of the first release block 37 and the flange portion 19*b*, the dimensions of the first release block and the angle of reciprocal rotation of the release shaft 40** are suitably selected.

In this embodiment, the output shaft 2 of the intermittent motion mechanism 3 and the main roll 4 are rotated intermittently in one direction so that the plate 7 clamped between the main roll 4 and the subroll 8 can be transported or conveyed in one direction intermittently. The roll feed apparatus of the type described is used as a means for intermittently feeding sheet metal into a pair of forming dies. In order to form sheet metal, various types of dies are used. In order to correctly position the metal strip or the like in the dies, it is often required to release the clamping force applied to the metal strip from the main roll 4 and the subroll 8 in synchronization with the feed of the metal strip or the like. The release device 21 of the type described above is provided in order to release the metal strip or the like at a proper time. If the release of the metal strip or the like 7 is not needed, the adjusting dial 39 is so rotated as to move the first release block 37 to the inoperative position 37' (in FIG. 3).

As described previously, in this embodiment, the engaging roll **8*b* consists of a thin-wall cylinder, but it is of course possible to make it in the form of a thick-wall cylinder. In the latter case, there is fear that the plate or the like 7 which has passed between the main roll 4 and the engaging roll 8*b* is curved upwardly as indicated by the chain lines 7' in FIG. 2. However, the thin-wall engaging roll 8*b* has a higher degree of elasticity so that its cylindrical wall can elastically deform itself when the plate or sheet metal 7** passes between the main roll 4 and the engaging roll 8*b* and consequently the deformation of plate or sheet metal can be avoided.

Referring back to FIG. 1, the intermittent motion mechanism generally indicated by the reference numeral 3 has an input unit 41, a cam shaft 44, an interlocking device 50 and a clutch device 51.

Figure 9:
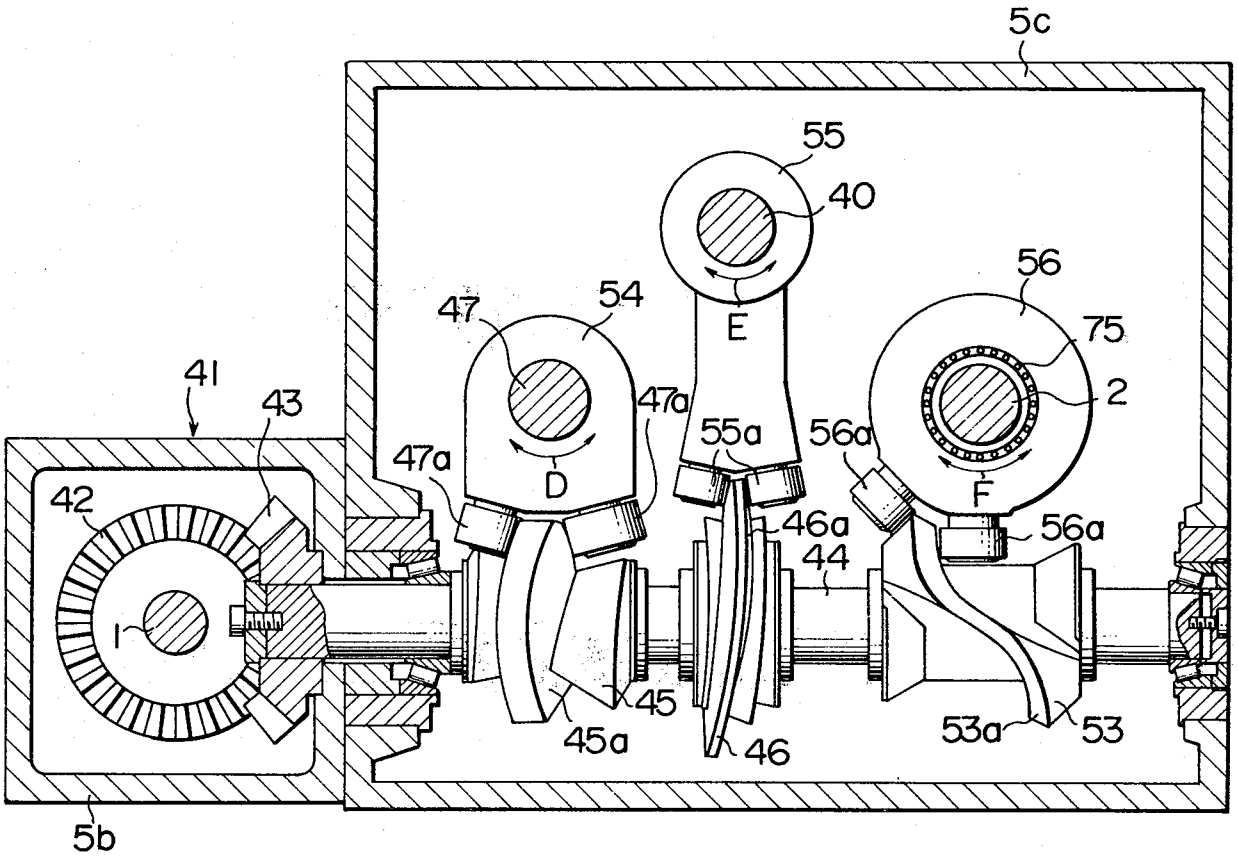
FIG. 9 is a view used to explain the arrangement of an input unit, cams and turrets of an intermittent motion mechanism.

As shown in FIGS. 1 and 9, the input shaft 1 is supported by an input-shaft housing 5*b* of the input unit 41 in which are disposed a pair of intermeshing bevel gears 42 and 43. The input shaft 1 is drivingly coupled through the pair of bevel gears 42 and 43 to the cam shaft 44. A first cam 45, a second cam 53 and a third cam 46 are supported on the cam shaft 44 to drive a first turret 54 carried by an intermediate drive shaft 47, a second turret 56 carried by the clutch device 51 and a third turret 55 carried by the release shaft 40, respectively. Two rolling cam followers 47*a* are supported by the first turret 54 and make rolling contact with the cam surfaces 45*a* of the first cam 45. The continuous rotation in one direction of the cam 45 causes oscillatory motion as indicated by a double-pointed arrow D in FIG. 9. In like manner, the second and third turrets 56 and 55 are provided with cam followers 55*a* and 56*a*, respectively, which make rolling contact with the cam surfaces 53*a* and 46*a*, respectively, of the second and third cams 53 and 46. These cam surfaces 53*a* and 46*a* are so designed and constructed that upon rotation of the second and third cams 54 and 46, the second and third turrets 56 and 55 make oscillatory motions as indicated by double-pointed arrow F and E, respectively. Upon oscillatory motions of the first and third turrets 54 and 55, the intermediate drive shaft 47 and the release shaft 40 make oscillatory motions in unison therewith. Oscillatory motion of the second turret 56 will be described in more detail below. Reference numeral 5*c* denotes a main housing of the intermittent motion mechanism 3.

Figure 10:
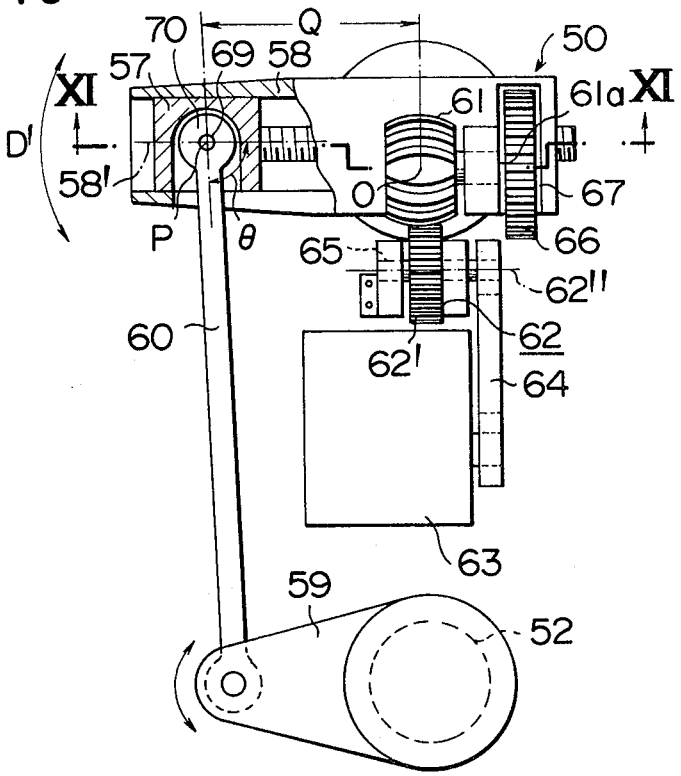
FIG. 10 is a side view of a connecting mechanism.
Figure 11:
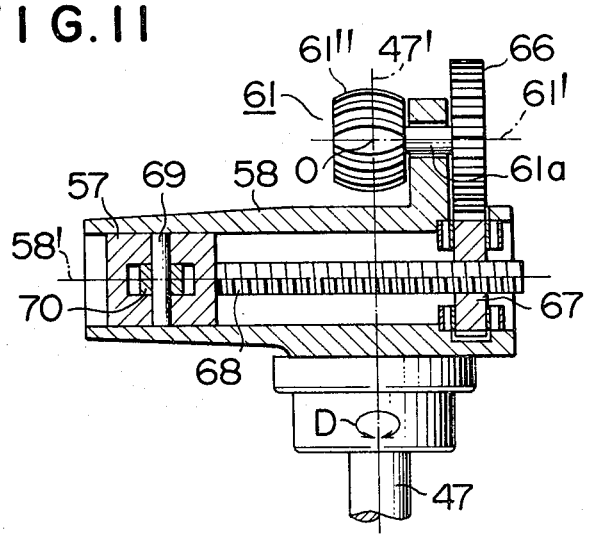
FIG. 11 is a sectional view taken along the line XI—XI of FIG. 10.

Referring next to FIGS. 1, 10 and 11, the interlocking device 50 includes a first swinging arm 58 which is extended substantially perpendicular to the intermediate drive shaft 47 (See FIG. 11), whose one end is securely joined to the shaft 47 and in which is housed a slider 57; a second swinging arm 59 (See also FIG. 12 or 13) which is extended in parallel with the first swinging arm 58 and whose one end is connected to a rotary sleeve 52 of the clutch device 51; a connecting rod 60 interconnecting between the slider 57 and the other end of the second swinging arm 69; a crown gear 61 supported by the first swinging arm 58 and a spur gear 62 which is rotatably supported by a main housing 5*c* (See FIG. 1) and is in mesh with the crown gear 61. When the intermediate drive shaft 47 makes oscillatory motion D, the crown gear 61 is caused not only to make oscillatory motion D′ in unison with the first swinging arm 58 but also to make rotation in a plane containing the axis 47′ of the intermediate drive shaft 47 and the axis of the first swinging arm 58; that is, the axis 61′ perpendicular to the axis 47′ of the intermediate drive shaft 47 shown in FIG. 11. The teeth 61″ of the crown gear 61 lie in the surface of a spherical segment or zone whose center is the intersection O between the axes 47′ and 61′ and are in the form of arcs whose centers are also at O and in mesh with the teeth 62′ of the spur gear 62. Therefore when the crown gear 61 makes oscillatory motion D′ about the axis 47′ of the intermediate drive shaft 47, the teeth 61″ of the crown gear slide relative to the teeth 62′ and hence the oscillatory motion D′ is not transmitted to the spur gear 62, but when the spur gear 62 is rotated about its axis 62″, the crown gear 61 is caused to rotate about the axis 61′.

In FIGS. 1 and 10, reference numeral 63 represents a driving motor which is drivingly coupled through a timing belt 64 to the rotary shaft 65 which carries the spur gear 62.

Referring still FIGS. 10 and 11, a driving gear 66 supported at the right end of the shaft 61*a* of the crown gear 61 is in mesh with a driven gear 67 threadably engaged at the right end of a screw shaft 68 extended through the first swinging arm 58. The left end of the scew shaft 68 is securely fixed to the slider 57. Therefore the rotation of the motor 63 is transmitted through the timing belt 64, the spur gear 62, the crown gear 61, the driving gear 66 and the driven gear 67 to the screw shaft or rod 68, whereby the screw shaft 68 and hence the slider 57 are caused to move axially of the first swinging arm 58 and consequently the length of one crank; that is; the distance between the slider 57 and the driven gear 67, of the four-bar linkage consisting of the screw shaft or rod 68, the link or connecting rod 60 and the second arm or crank 69, is changed. As a result, the angle of swinging motion of the second arm 59 relative to that of the first arm 57 can be changed as will be described in more detail below. In FIGS. 10 and 11, a reference numeral 69 indicates a stationary pin supported in the slider 57; and 70, a bearing mounted thereon. The slider 57 and the connecting rod 60 are interconnected with such pin and bearing. In like manner, the connecting rod 60 and the second swinging arm 59 are interconnected.

Referring next to FIGS. 12–15, the clutch device 51 comprises a needle bearing 75 on the output shaft 2 in such a way that the second turret 56 can be not only rotated about the axis of the output shaft 2 but also slidably moved axially thereof. A stationary block 78 is securely mounted on the main housing 5*c* with bolts 75 and rotatably supports one end of the output shaft 2 through a bearing 76. The second turret 56 and the stationary block 78 are interconnected with connecting rods 77 and 77′ through socket-and-ball couplings 90, 90′, 91 and 91′ (See FIG. 14 or 15) in such a way that upon rotation of the second cam 53 (See FIG. 9) and hence oscillatory motion F of the second turret 56, the latter is caused to reciprocate axially of the output shaft 2 as indicated by a double-pointed arrow X in FIG. 14 or 15.

Figure 12:
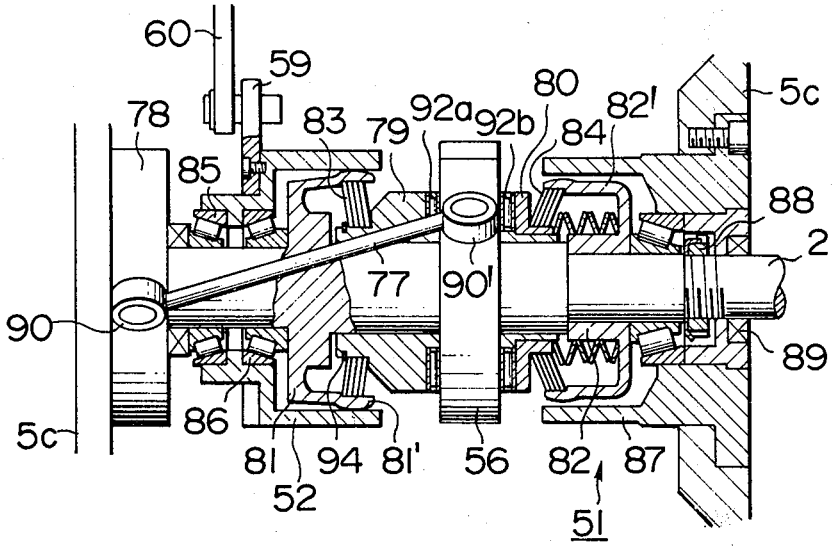
FIG. 12 is a view of a clutch connecting between a second swinging arm and an output shaft.
Figure 13:
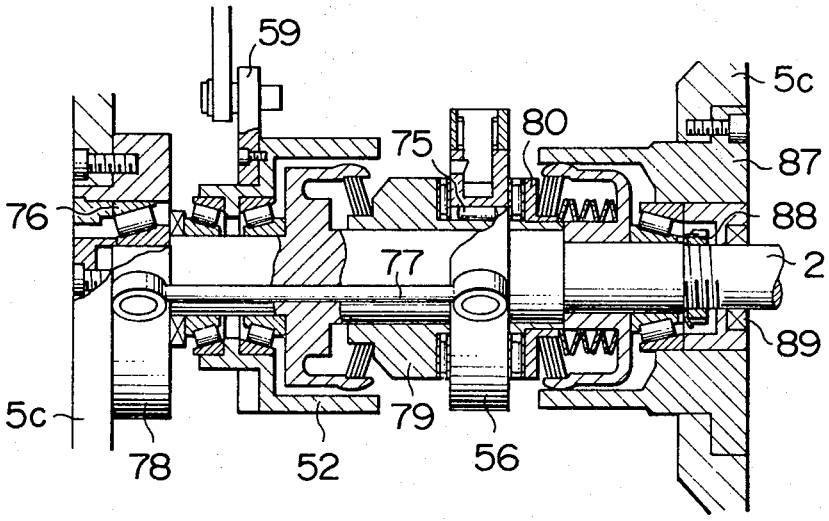
FIG. 13 is a view of the clutch disconnecting the second swinging arm from the output shaft.

Still referring to FIGS. 12 and 13, a first sliding member 79 and a second sliding member 80 are slidably fitted over the output shaft 2 on both sides of the second turret 56, respectively, for axial movement along the output shaft 2. A first locking member 81 is rigidly mounted on the output shaft 2 on the left side of the first sliding member 79 and a second locking member 82, on the right side of the second sliding member 80. The first locking member 81 has an elastic flange 81′ which is so shaped as to surround the left portion of the first sliding member 79 and a spring 83 is loaded between the elastic flange 81′ and the left portion of the first sliding member 89. In like manner, the second locking member 82 has an elastic flange 82′ which is so shaped as to surround the right portion of the second sliding member 80 and a spring 84 is loaded between the elastic flange 82′ and the right portion of the second sliding member 80. The rotary sleeve 52 which is supported on the output shaft 2 through bearings 85 and 86 surrounds the elastic flange portion 81′ of the first locking member 81 and a stationary sleeve 87 rigidly mounted on the main housing 5c surrounds the elastic flange portion 82′ of the second locking member 82. As described previously and shown in FIG. 10, the rotary sleeve 52 is connected to the second swinging arm 59 of the interlocking device 50.

In FIGS. 12 and 13, reference numerals 88, 89 and 94 represent a locking bolt, an oil seal and a locking clip, respectively. A needle bearing 92a is interposed between the second turret 56 and the first sliding member 79 so that they can rotate relative to each other. In like manner, a needle bearing 92b is interposed between the second turret 56 and the second sliding member 80 so that they can rotate relative to each other.

Figure 16:
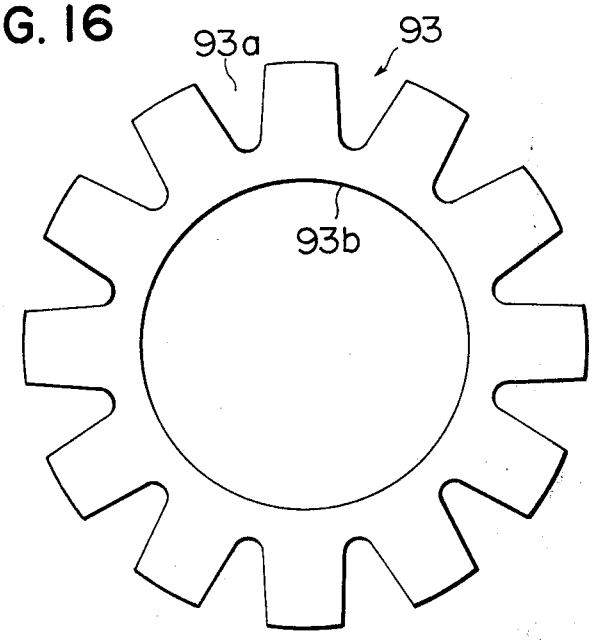
FIG. 16 is a top view of an expansion ring.
Figure 17:
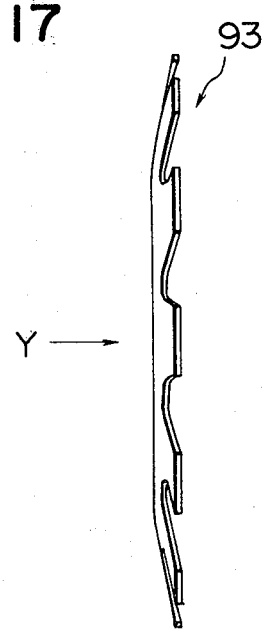
FIG. 17 is a side view thereof.

Each of the springs 83 and 84 consists of a plurality of stacked expansion springs 93 of the type as shown in FIGS. 16 and 17. The expansion spring 93 is in the form of a frustoconical spring blank formed with a plurality of notches 93a along its periphery. Therefore when the force is applied in the direction Y along the inner periphery 93b, the expansion spring 93 is caused to expand radially outwardly. As shown in FIG. 12 or 13, these expansion springs 93 which constitute the spring 83 are so stacked that the outer periphery of each expansion spring 93 is located axially to the left of the inner periphery thereof. In like manner, the expansion springs 93 which constitute the spring 84 is so stacked that the outer periphery of each expansion spring 93 is located axially to the right of the inner periphery thereof.

The clutch device 51 with the above-described construction serves to connect or disconnect the second swinging arm 59 and hence the rotary sleeve 52 with or from the output shaft 2. That is, FIG. 12 shows that the second swinging arm 59 is connected to the output shaft. The second turret 56 and the first and second sliding member 79 and 80 are displaced to the left so that the spring 83 is expanded radially outwardly and consequently the elastic flange portion 81′ of the first locking member 81 is deformed radially outwardly, against the friction engagement with the inside surface of the rotary sleeve 52. In this case, the spring 84 is contracted radially inwardly so that the elastic flange portion 82′ of the second locking member 82 is moved away from the stationary sleeve 87. As a result, the oscillatory motion of the second swinging arm 59 is transmitted through the rotary sleeve 52 and the elastic flange portion 81′ of the first locking member 81 of the output shaft 2. Thus, when the input shaft 1 rotates, the second swinging arm 59 make oscillatory motion as described above and the rotary sleeve 52, the first locking member 81, the spring 83, the first sliding member 82 are all caused to make oscillatory rotations, respectively, in unison with the output shaft 2.

Figure 14:
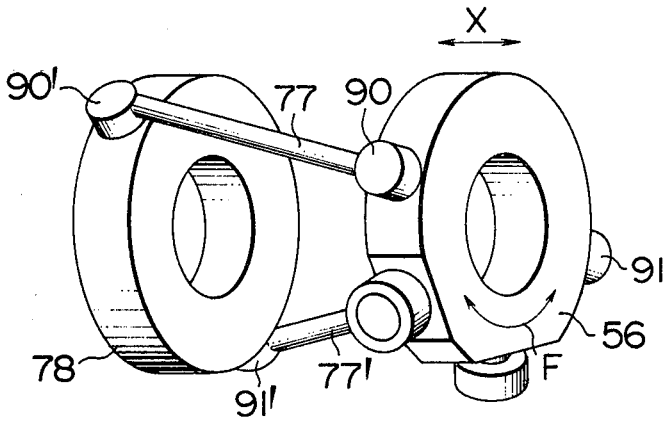
FIGS. 14 and 15 are views used to explain the relationship between a stationary block and a second turret of the clutch device shown in FIGS. 12 and 13.
Figure 15:
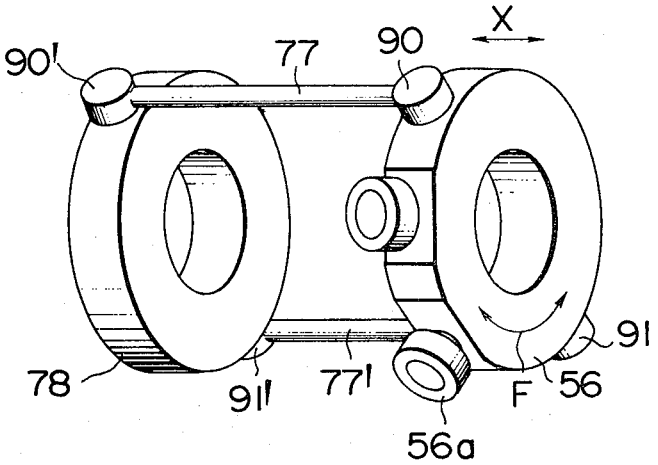

When the second turret 56 rotates as indicated by the arrow in FIG. 14 or 15 from the angular position as shown in FIG. 12, it is displaced along the output shaft 2 to the right position as shown in FIG. 13 together with the first and second sliding members 79 and 80. Then the spring 83 is caused to contract radially inwardly so that the elastic flange 81′ returns to its normal shape and is moved away from the rotary sleeve 52, but the spring 84 is expanded radially outwardly so that the elastic flange portion 82′ of the second locking member 82 is deformed radially outwardly to make frictional engagement with the stationary sleeve 87. As a result, the oscillatory motion or rotation of the second swinging arm 52 is not transmitted through the rotary sleeve 52 to the output shaft 2. Since the elastic flange portion 82′ of the second locking member 82 positively engages with the stationary sleeve 87, the output shaft 2 can be positively maintained stationary.

The function of the intermittent motion mechanism 3 may be summarized as follows. Upon rotation of the input shaft 1, the cam shaft 44 and the first cam 45 supported thereby are rotated. Then the first turret 54 and the intermediate drive shaft 47 are oscillated about their axes and consequently the first swinging arm 58 carried by the intermediate drive shaft 47 make oscillatory motion or rotation (See FIGS. 1, 10 and 11). The oscillatory motion of the first swinging arm 58 is transmitted through the connecting rod 60 to the second swinging arm 59 so that the rotary sleeve 52 (See FIGS. 1, 12 and 13) make oscillatory rotation. In unison with the rotation of the input shaft 1, the second and third cams 53 and 46 are rotated so that the second and third turrets 56 and 55 make oscillatory motions, respectively. The oscillatory motion of the second turret 56 causes the clutch device 51 to connect or disconnect the second swinging arm 59 with or from the output shaft 2 as described above with reference to FIGS. 12 and 13.

With the coupling device 51 in the position as shown in FIG. 12, the output shaft 2 is caused to rotate in unison with the rotary sleeve 52 and hence the second swinging arm 59, but in the position as shown in FIG. 13, the output shaft 2 is disconnected from the rotary sleeve 52 and therefore maintained stationary. The clutch device 51 is so designed and constructed that when the rotary sleeve 52 rotates in one direction, the clutch device 51 connects the second swinging arm 59 to the output shaft 2 as shown in FIG. 12, but when the rotary sleeve 52 rotates in the other direction, the clutch device 51 disconnects the second swinging arm 59 from the output shaft 2 as shown in FIG. 13. Then, the output shaft 2 is caused to rotate intermittently in one direction. That is, it is so designed and constructed that the rotating sleeve 52 dwells a predetermined short time interval at each end of the stroke of the reciprocal or oscillatory rotation thereof; that is, the time when the rotating sleeve 52 reverses its direction of rotation so that during the dwell time the second turret 56 can be displaced between the positions shown in FIGS. 12 and 13, respectively. Such arrangement can be easily obtained by suitable designs of the cam surfaces of the first and second cams 54 and 56.

The oscillatory motion or rotation of the third cam 55 is transmitted to the release shaft 40 so that the release device 21 is actuated as described previously with reference to FIG. 3.

Referring back to FIGS. 10 and 11, the angle of rotation or swing of the second swinging arm 59 with respect to that of the first swinging arm 58 can be varied by displacing the slider 57 along the axis 58′ of the first swinging arm 58 as described previously. As best shown in FIG. 11, the first swinging arm 58 makes oscillatory motion or rotation about the axis 47′ of the intermediate shaft 47; that is, the point O in FIG. 10. If the slider 57 is axially displaced, the distance Q between the pin joint P between the first swinging arm 58 and the connecting rod 60 on the one hand and the point O changes and consequently the angle $\theta$ between the axis 58′ and the axis of the connecting rod 60 changes. As a result, the angle of rotation or swing of the second swinging arm 59 changes even when the angle of rotation or swing of the first swinging arm 58 remains unchanged and consequently the angle of rotation of the rotary sleeve 52 and hence the output shaft 2 changes accordingly.

As described previously, the slider 57 is displaced axially by driving the motor 63. That is, the rotation of the motor 63 is transmitted through the belt 64, the spur gear 62, the crown gear 61, the driving gear 66 and the driven gear 67 to the screw shaft or rod 68, whereby the latter is displaced axially of the first swinging arm 58; that is, along the axis 58'. Upon rotation of the first cam 45, the intermediate drive shaft 47 makes oscillatory motion or rotation so that the first swinging arm 58 carried at the extreme end of the intermediate drive shaft 47 and the crown gear 61 carried by the first arm 58 also make oscillatory motions or rotations. In the case, even through the crown gear 61 and the spur gear 62 are in mesh with each other, the oscillatory rotation of the crown gear 61 cannot be transmitted to the spur gear 62 because the teeth 61' of the crown gear 61 just pass the spaces between the adjacent teeth 62' of the spur gear 62 as described previously. It is of course possible to use a manually operable handlewheel instead of the motor 63 so that the displacement of the slider 57 can be manually adjusted.

In summary, according to the present invention, the input shaft 1 of the intermittent motion mechanism 3 is continuously rotated and the output shaft 2 is intermittently rotated in one direction so that the plate or sheet metal 7 clamped between the main roll 4 and the subroll 8 can be also intermittently fed. The subroll 8 comprises the rotation-transmission roll **8*a* and the roll 8*b* which engages with the plate or sheet metal being fed. The pressure with which the rotation-transmission roll 8*a* is pressed against the main roll 4 can be easily adjusted by operating the first adjusting device 13 to rotate the eccentric flange 10, whereby the transmission of the rotating force from the main roll 4 to the subroll 8 can be optimized. In addition, the engaging roll 8*b* can be moved toward or away from the main roll 4 by operating the second adjusting device 18 to displace the roll holder 4 in the manner described previously so that, regardless of variations in thickness, plates or sheet metal can be clamped with an optimized clamping force between the main roll 4 and the subroll 8. Moreover, the plate or sheet metal 7 can be passed between the main roll 4 and the subroll 8 at a predetermined feed or velocity with a higher degree of accuracy. Furthermore, loading of the workpiece 7 between the main roll 4 and the subroll 8** and the taking-out or unloading thereof can be much facilitated.

As described previously in detail with reference to FIGS. 2 and 3, the second adjusting device 18 is provided with the eccentric rod 24 and the pressure adjusting device 20 so that the displacement of the roll holder 19 and the adjustment of the clamping force exerted to the workpiece being passed can be accomplished in a very simple manner. In addition, the second adjusting device 18 is provided with the release device 21 which is operatively connected to the release shaft 40 of the intermittent motion mechanism 3 so that the clamping force applied to the workpiece 7 can be released in suitable timing relationship with the intermittent feed of the workpiece 7.

With the intermittent motion mechanism 3 which incorporates the cams and turrets as described previsouly, the output shaft 2 thereof and hence the main roll 4 can be intermittently rotated in one direction with a higher degree of accuracy. Therefore, the intermittent motion mechanism 3 in accordance with the present invention is by far advantageous in operational accuracy over the transmission device which slips in transmission or the intermittent motion mechanism which consists of a large number of gears so that it fails to operate smoothly when started because of the backlash between the gears. Frictional forces are utilized in transmitting the rotation of the main roll 4 to the rotation-transmission roll **8*a* and in feeding the workpiece 7 between the main roll 4 and the engaging roll 8*b*. As a result, the workpiece 7 can be fed with a higher degree of accuracy. Thus, the combination of the intermittent motion mechanism 3 with the roll mechanism consisting of the main roll 4, the subroll 8 and the first and second adjusting devices 13 and 18** can ensure the accurate operation of the roll feed apparatus as a whole.

The interlocking device 50 of the intermittent motion mechanism 3 has the advantage that the angle of oscillatory rotation of the second swinging arm 59 can be varied with respect to that of the first swinging arm 58 (See FIG. 10) by displacing the slider 57 along the axis 58' (See FIG. 10 or 11) so that the angle of one step rotation of the output shaft 4 can be varied. This advantage is pronounced particularly when the roll feed apparatus in accordance with the present invention is incorporated with the automatic production machine adapted for mass production of various products or for production in small quantity of various products. That is, the angle of one step rotation of the main roll 4 which is carried by the output shaft 2 can be varied by changing the angle of one step rotation of the output shaft so that the feed of the workpiece 7 by one step rotation of the main roll 4 can be varied. Therefore when it is needed to change the types of products to be finished or manufactured from the workpieces, the feed of workpieces can be so varied that the workpieces can be fed to their respective destinations or working stations in which various types of machine tools are disposed.

What is claimed is:

1. A roll feed apparatus comprising:

an intermittent motion mechanism adapted to translate the continuous rotation of an input shaft into the intermittent rotation in one direction of an output shaft;

a main roll rigidly fitted over said output shaft;

a roll housing;

a subroll shaft extended substantially in parallel with said output shaft;

eccentric means for rotatably supporting said subroll shaft in said roll housing;

a subroll rigidly supported on said subroll shaft and adapted to coact with said main roll to clamp and feed a workpiece therebetween, said subroll comprising a rotation-transmission roll disposed at one axial end of and rigidly supported by said subroll shaft, said rotation transmission roll having a cylindrical peripheral surface for rolling contact with said main roll, a workpiece-engaging roll surrounding said subroll shaft, and means for flexibly supporting said workpiece-engaging roll from said rotation-transmission roll;

a first adjusting means operatively associated with said eccentric means for rotating said eccentric means to cause said subroll shaft to move toward or away from said output shaft, whereby the contact pressure between said main roll and said rotation-transmission roll can be adjusted;

a roll holder rotatably supporting said workpiece-engaging roll, said roll holder being supported by said roll housing; and second adjusting means for moving said roll holder in unison with said workpiece-engaging roll to cause said workpiece-engaging roll to move toward or away from said main roll.

2. A roll feed apparatus as set forth in claim 1, wherein said workpiece-engaging roll includes a thin-walled cylindrical roll.

3. A roll feed apparatus as set forth in claim 1 or 2, wherein said interlocking device comprises a first swinging arm whose end is rigidly connected to one end of said intermediate drive shaft and which is extended substantially perpendicular to the axis of said intermediate drive shaft and in which is disposed a slider for axial slidable movement, a second swinging arm whose one end is rigidly connected to said rotating sleeve and which is extended in parallel with said first swinging arm, a connecting rod for interconnecting between the other end of said second swinging arm and said slider, a crown gear supported on said first swinging arm in such a way that said crown gear is rotated in unison with said first swinging arm about the axis of said intermediate drive shaft and also rotated about the axis of rotation perpendicular to said axis of said intermediate drive shaft in a plane containing both the axis of said first swinging arm and the axis of said intermediate drive shaft, and a spur gear in mesh with said crown gear, whereby said crown gear is operatively connected to said slider in such a way that the rotation of said crown gear which in turn is caused by the rotation of said spur gear causes the axial slidable movement of said slider in said first swinging arm; and the teeth of said crown gear are cut or otherwise formed in the spherical surface of a spherical segment whose center is at the point of intesection between the axis of said intermediate drive shaft and said axis of rotation and are arcuately extended in the median direction of said spherical segment, whereby when said crown gear makes a reciprocal or oscillatory motion in unison with said first swinging arm, the teeth of said crown gear can pass the spaces between the adjacent teeth of said spur gear without any contact with the teeth of the spur gear.

4. A roll feed apparatus as set forth in claim 1 or 2, wherein said intermittent motion mechanism includes a first rotating cam carried by a cam shaft operatively coupled to said input shaft, a first turret which is fixedly fitted on an intermediate drive shaft extended in parallel with said output shaft and which is caused to make a reciprocal or oscillatory rotation by the rotation of said first rotating cam, a rotating sleeve supported by said output shaft adjacent to one end thereof for reciprocal or oscillatory rotation, an interlocking device which is adapted to interlock between said intermediate drive shaft and said rotating sleeve, and a clutch device for connecting or disconnecting said rotating sleeve with or from said output shaft; and said clutch device includes a stationary sleeve which rotatably supports the other end of said output shaft and which is spaced apart from said rotating sleeve, a second cam rigidly supported on said cam shaft for rotation in unison therewith, a second turret which is fitted over said output shaft between said rotating and stationary sleeves and operatively coupled to said second cam in such a way that at one end of the stroke of said reciprocal or oscillatory rotation of said rotating sleeve said second turret is caused to rotate in one direction to be displaced toward said rotating sleeve and at the other end of said stroke said second turret is caused to rotate in the other direction to be displaced toward said stationary sleeve by a predetermined distance, a first locking member which is rigidly supported by said output shaft and which has an elastic flange which is in opposed relationship with the inside peripheral surface of said rotating sleeve, a second locking member which is rigidly supported by said output shaft and which has an elastic flange which in turn is in opposed relationship with the inside peripheral surface of said stationary sleeve, a first sliding member and a second sliding member which are fitted over said output shaft for slidable movement thereof in unison with said second turret, and a spring locking means comprising a first expansion spring assembly which is loaded between said first sliding member and said elastic flange of said first locking member, and a second expansion spring assembly which is loaded between said second sliding member and said elastic flange of said second locking member, whereby when said second turret is slidably displaced toward said rotating sleeve, said first expansion spring assembly expands to press said elastic flange of said first locking member against said inside peripheral surface of said rotating sleeve and concurrently said second expansion spring assembly contracts to permit said elastic flange of said second locking member to move away from said inside peripheral surface of said stationary sleeve so that said output shaft can be connected to said rotating sleeve for rotation in unison therewith, but when said second turret is slidably displaced toward said stationary sleeve, said first expansion spring assembly contracts to permit said elastic flange of said first locking member to move away from said inside peripheral surface of said rotating sleeve and concurrently said second expansion spring assembly expands to press said elastic flange of said second locking member against said inside peripheral surface of said stationary sleeve so that said output shaft can be disconnected from said rotating sleeve and maintained stationary.

5. A roll feed apparatus as set forth in claim 4, wherein said interlocking device comprises a first swinging arm whose end is rigidly connected to one end of said intermediate drive shaft and which is extended substantially perpendicular to the axis of said intermediate drive shaft and in which is disposed a slider for axial slidable movement, a second swinging arm whose one end is rigidly connected to said rotating sleeve and which is extended in parallel with said first swinging arm, a connecting rod for interconnecting between the other end of said second swinging arm and said slider, a crown gear supported on said first swinging arm in such a way that said crown gear is rotated in unison with said first swinging arm about the axis of said intermediate drive shaft and also rotated about the axis of rotation perpendicular to said axis of said intermediate drive shaft in a plane containing both the axis of said first swinging arm and the axis of said intermediate drive shaft, and a spur gear in mesh with said crown gear, whereby said crown gear is operatively connected to said slider in such a way that the rotation of said crown gear which in turn is caused by the rotation of said spur gear causes the axial slidable movement of said slider in said first swinging arm; and the teeth of said crown gear are cut or otherwise formed in the spherical surface of a spherical segment whose center is at the point of intersection between the axis of said intermediate drive shaft and said axis of rotation and are arcuately extended in the median direction of said spherical segment, whereby when said crown gear makes a reciprocal or oscillatory motion in unison with said first swinging arm, the teeth of said crown gear can pass the spaces between the adjacent teeth of said spur gear without any contact with the teeth of the spur gear.

6. A roll feed apparatus as set forth in claim 1 or 2, wherein said second adjusting means comprises an eccentric rod having a large diameter intermediate portion and small diameter end portions which are eccentrically extended from the ends, respectively, of said large diameter intermediate portion and rotatably supported by said roll housing;

one end of said roll holder is rotatably fitted over said large diameter intermediate portion of said eccentric rod so that when said eccentric rod is rotated, said roll holder is so displaced that said workpiece-engaging roll is caused to move toward or away from said main roll and when said roll holder is rotated about said eccentric rod, said workpiece-engaging roll is caused to move toward or away from said main roll; and said second adjusting means further comprises a pressure adjusting device including a spring for pressing said roll holder in such a direction in which said workpiece-engaging roll is caused to press against said main roll, and a means for adjusting the force of said spring.

7. A roll feed apparatus as set forth in claim 1 wherein said intermittent motion mechanism includes a first rotating cam carried by a cam shaft operatively coupled to said input shaft, a first turret which is fixedly fitted on an intermediate drive shaft extended in parallel with said output shaft and which is caused to make a reciprocal or oscillatory rotation by the rotation of said first rotating cam, a rotating sleeve supported by said output shaft adjacent to one end thereof for reciprocal or oscillatory rotation, an interlocking device which is adapted to interlock between said intermediate drive shaft and said rotating sleeve, and a clutch device for connecting or disconnecting said rotating sleeve with or from said output shaft; and said clutch device includes a stationary sleeve which rotatably supports the other end of said output shaft and which is spaced apart from said rotating sleeve, a second cam rigidly supported on said cam shaft for rotation in unison therewith, a second turret which is fitted over said output shaft between said rotating and stationary sleeves and operatively coupled to said second cam in such a way that at one end of the stroke of said reciprocal or oscillatory rotation of said rotating sleeve said second turret is caused to rotate in one direction to be displaced toward said rotating sleeve and at the other end of said stroke said second turret is caused to rotate in the other direction to be displaced toward said stationary sleeve by a predetermined distance, a first locking member which is rigidly supported by said output shaft and which has an elastic flange which is in opposed relationship with the inside peripheral surface of said rotating sleeve, a second locking member which is rigidly supported by said output shaft and which has an elastic flange which in turn is in opposed relationship with the inside peripheral surface of said stationary sleeve, a first sliding member and a second sliding member which are fitted over said output shaft for slidable movement thereof in unison with said second turret, and a spring locking means comprising a first expansion spring assembly which is loaded between said first sliding member and said elastic flange of said first locking member, and a second expansion spring assembly which is loaded between said second sliding member and said elastic flange of said second locking member, whereby when said second turret is slidably displaced toward said rotating sleeve, said first expansion spring assembly expands to press said elastic flange of said first locking member against said inside peripheral surface of said rotating sleeve and concurrently said second expansion spring assembly contracts to permit said elastic flange of said second locking member to move away from said inside peripheral surface of said stationary sleeve so that said output shaft can be connected to said rotating sleeve for rotation in unison therewith, but when said second turret is slidably displaced toward said stationary sleeve, said first expansion spring assembly contracts to permit said elastic flange of said first locking member to move away from said inside peripheral surface of said rotating sleeve and concurrently said second expansion spring assembly expands to press said elastic flange of said second locking member against said inside peripheral surface of said stationary sleeve so that said output shaft can be disconnected from said rotating sleeve and maintained stationary.

8. A roll feed apparatus as set forth in claim 7, wherein said interlocking device comprises a first swinging arm whose end is rigidly connected to one end of said intermediate drive shaft and which is extended substantially perpendicular to the axis of said intermediate drive shaft and in which is disposed a slider for axial slidable movement, a second swinging arm whose one end is rigidly connected to said rotating sleeve and which is extended in parallel with said first swinging arm, a connecting rod for interconnecting between the other end of said second swinging arm and said slider, a crown gear supported on said first swinging arm in such a way that said crown gear is rotated in unison with said first swinging arm about the axis of said intermediate drive shaft and also rotated about the axis of rotation perpendicular to said axis of said intermediate drive shaft in a plane containing both the axis of said first swinging arm and the axis of said intermediate drive shaft, and a spur gear in mesh with said crown gear, whereby said crown gear is operatively connected to said slider in such a way that the rotation of said crown gear which in turn is caused by the rotation of said spur gear causes the axial slidable movement of said slider in said first swinging arm; and the teeth of said crown gear are cut or otherwise formed in the spherical surface of a spherical segment whose center is at the point of intersection between the axis of said intermediate drive shaft and said axis of rotation and are arcuately extended in the median direction of said spherical segment, whereby when said crown gear makes a reciprocal or oscillatory motion in unison with said first swinging arm, the teeth of said crown gear can pass the spaces between the adjacent teeth of said spur gear without any contact with the teeth of the spur gear.

9. A roll feed apparatus as set forth in claim 6, wherein said intermittent motion mechanism comprises:

a release shaft which is caused to make a reciprocal or oscillatory rotation through a predetermined angle by the continuous rotation of said input shaft;

said second adjusting means comprises a release device which has a release block which in turn is fitted over said release shaft adjacent to the other end of said roll holder; and said release device pushes said other end of said roll holder when said release block makes a reciprocal or oscillatory rotation in unison with said release shaft so that said roll holder is caused to rotate about said eccentric rod in a direction in which said workpiece-engaging roll is caused to move away from said main roll.

10. A roll feed apparatus as set forth in claim 9, wherein said interlocking device comprises a first swinging arm whose end is rigidly connected to one end of said intermediate drive shaft and which is extended substantially perpendicular to the axis of said intermediate drive shaft and in which is disposed a slider for axial slidable movement, a second swinging arm whose one end is rigidly connected to said rotating sleeve and which is extended in parallel with said first swinging arm, a connecting rod for interconnecting between the other end of said second swinging arm and said slider, a crown gear supported on said first swinging arm in such a way that said crown gear is rotated in unison with said first swinging arm about the axis of said intermediate drive shaft and also rotated about the axis of rotation perpendicular to said axis of said intermediate drive shaft in a plane containing both the axis of said first swinging arm and the axis of said intermediate drive shaft, and a spur gear in mesh with said crown gear, whereby said crown gear is operatively connected to said slider in such a way that the rotation of said crown gear which in turn is caused by the rotation of said spur gear causes the axial slidable movement of said slider in said first swinging arm; and the teeth of said crown gear are cut or otherwise formed in the spherical surface of a spherical segment whose center is at the point of intersection between the axis of said intermediate drive shaft and said axis of rotation and are arcuately extended in the median direction of said spherical segment, whereby when said crown gear makes a reciprocal or oscillatory motion in unison with said first swinging arm, the teeth of said crown gear can pass the spaces between the adjacent teeth of said spur gear without any contact with the teeth of the spur gear.

11. A roll feed apparatus as set forth in claim 9, wherein said intermittent motion mechanism includes a first rotating cam carried by a cam shaft operatively coupled to said input shaft, a first turret which is fixedly fitted on an intermediate drive shaft extended in parallel with said output shaft and which is caused to make a reciprocal or oscillatory rotation by the rotation of said first rotating cam, a rotating sleeve supported by said output shaft adjacent to one end thereof for reciprocal or oscillatory rotation, an interlocking device which is adapted to interlock between said intermediate drive shaft and said rotating sleeve, and a clutch device for connecting or disconnecting said rotating sleeve with or from said output shaft; and said clutch device includes a stationary sleeve which rotatably supports the other end of said output shaft and which is spaced apart from said rotating sleeve, a second cam rigidly supported on said cam shaft for rotation in unison therewith, a second turret which is fitted over said output shaft between said rotating and stationary sleeves and operatively coupled to said second cam in such a way that at one end of the stroke of said reciprocal or oscillatory rotation of said rotating sleeve said second turret is caused to rotate in one direction to be displaced toward said rotating sleeve and at the other end of said stroke said second turret is caused to rotate in the other direction to be displaced toward said stationary sleeve by a predetermined distance, a first locking member which is rigidly supported by said output shaft and which has an elastic flange which is in opposed relationship with the inside peripheral surface of said rotating sleeve, a second locking member which is rigidly supported by said output shaft and which has an elastic flange which in turn is in opposed relationship with the inside peripheral surface of said stationary sleeve, a first sliding member and a second sliding member which are fitted over said output shaft for slidable movement thereof in unison with said second turret, and a spring locking means comprising a first expansion spring assembly which is loaded between said first sliding member and said elastic flange of said first locking member, and a second expansion spring assembly which is loaded between said second sliding member and said elastic flange of said second locking member, whereby when said second turret is slidably displaced toward said rotating sleeve, said first expansion spring assembly expands to press said elastic flange of said first locking member against said inside peripheral surface of said rotating sleeve and concurrently said second expansion spring assembly contracts to permit said elastic flange of said second locking member to move away from said inside peripheral surface of said stationary sleeve so that said output shaft can be connected to said rotating sleeve for rotation in unison therewith, but when said second turret is slidably displaced toward said stationary sleeve, said first expansion spring assembly contracts to permit said elastic flange of said first locking member to move away from said inside peripheral surface of said rotating sleeve and concurrently said second expansion spring assembly expands to press said elastic flange of said second locking member against said inside peripheral surface of said stationary sleeve so that said output shaft can be disconnected from said rotating sleeve and maintained stationary.

12. A roll feed apparatus as set forth in claim 11, wherein said interlocking device comprises a first swinging arm whose end is rigidly connected to one end of said intermediate drive shaft and which is extended substantially perpendicular to the axis of said intermediate drive shaft and in which is disposed a slider for axial slidable movement, a second swinging arm whose one end is rigidly connected to said rotating sleeve and which is extended in parallel with said first swinging arm, a connecting rod for interconnecting between the other end of said second swinging arm and said slider, a crown gear supported on said first swinging arm in such a way that said crown gear is rotated in unison with said first swinging arm about the axis of said intermediate drive shaft and also rotated about the axis of rotation perpendicular to said axis of said intermediate drive shaft in a plane containing both the axis of said first swinging arm and the axis of said intermediate drive shaft, and a spur gear in mesh with said crown gear, whereby said crown gear is operatively connected to said slider in such a way that the rotation of said crown gear which in turn is caused by the rotation of said spur gear causes the axial slidable movement of said slider in said first swinging arm; and the teeth of said crown gear are cut or otherwise formed in the spherical surface of a spherical segment whose center is at the point of intersection between the axis of said intermediate drive shaft and sais axis of rotation and are arcuately extended in the median direction of said spherical segment, whereby when said crown gear makes a reciprocal or oscillatory motion in unison with said first swinging arm, the teeth of said crown gear can pass the spaces between the adjacent teeth of said spur gear without any contact with the teeth of the spur gear.

13. A roll feed apparatus as set forth in claim 1, wherein said intermittent motion mechanism comprises:

a release shaft which is caused to make a reciprocal or oscillatory rotation through a predetermined angle by the continuous rotation of said input shaft;

said second adjusting means comprises a release device which has a release block which in turn is fitted over said release shaft adjacent to the other end of said roll holder; and said release device pushes said other end of said roll holder when said release block makes a reciprocal or oscillatory rotation in unison with said release shaft so that said roll holder is caused to rotate about said eccentric rod in a direction in which said workpiece-engaging roll is caused to move away from said main roll.

14. A roll feed apparatus as set forth in claim 13, wherein said intermittent motion mechanism includes a first rotating cam carried by a cam shaft operatively coupled to said input shaft, a first turret which is fixedly fitted on an intermediate drive shaft extended in parallel with said output shaft and which is caused to make a reciprocal or oscillatory rotation by the rotation of said first rotating cam, a rotating sleeve supported by said output shaft adjacent to one end thereof for reciprocal or oscillatory rotation, an interlocking device which is adapted to interlock between said intermediate drive shaft and said rotating sleeve, and a clutch device for connecting or disconnecting said rotating sleeve with or from said output shaft; and said clutch device includes a stationary sleeve which rotatably supports the other end of said output shaft and which is spaced apart from said rotating sleeve, a second cam rigidly supported on said cam shaft for rotation in unison therewith, a second turret which is fitted over said output shaft between said rotating and stationary sleeves and operatively coupled to said second cam in such a way that at one end of the stroke of said reciprocal or oscillatory rotation of said rotating sleeve said second turret is caused to rotate in one direction to be displaced toward said rotating sleeve and at the other end of said stroke said second turret is caused to rotate in the other direction to be displaced toward said stationary sleeve by a predetermined distance, a first locking member which is rigidly supported by said output shaft and which has an elastic flange which is in opposed relationship with the inside peripheral surface of said rotating sleeve, a second locking member which is rigidly supported by said output shaft and which has an elastic flange which in turn is in opposed relationship with the inside peripheral surface of said stationary sleeve, a first sliding member and a second sliding member which are fitted over said output shaft for slidable movement thereof in unison with said second turret, and a spring locking means comprising a first expansion spring assembly which is loaded between said first sliding member and said elastic flange of said first locking member, and a second expansion spring assembly which is loaded between said second sliding member and said elastic flange of said second locking member, whereby when said second turret is slidably displaced toward said rotating sleeve, said first expansion spring assembly expands to press said elastic flange of said first locking member against said inside peripheral surface of said rotating sleeve and concurrently said second expansion spring assembly contracts to permit said elastic flange of said second locking member to move away from said inside peripheral surface of said stationary sleeve so that said output shaft can be connected to said rotating sleeve for rotation in unison therewith, but when said second turret is slidably displaced toward said stationary sleeve, said first expansion spring assembly contracts to permit said elastic flange of said first locking member to move away from said inside peripheral surface of said rotating sleeve and concurrently said second expansion spring assembly expands to press said elastic flange of said second locking member against said inside peripheral surface of said stationary sleeve so that said output shaft can be disconnected from said rotating sleeve and maintained stationary.

15. A roll feed apparatus as set forth in claim 14, wherein said interlocking device comprises a first swinging arm whose end is rigidly connected to one end of said intermediate drive shaft and which is extended substantially perpendicular to the axis of said intermediate drive shaft and in which is disposed a slider for axial slidable movement, a second swinging arm whose one end is rigidly connected to said rotating sleeve and which is extended in parallel with said first swinging arm, a connecting rod for interconnecting between the other end of said second swinging arm and said slider, a crown gear supported on said first swinging arm in such a way that said crown gear is rotated in unison with said first swinging arm about the axis of said intermediate drive shaft and also rotated about the axis of rotation perpendicular to said axis of said intermediate drive shaft in a plane containing both the axis of said first swinging arm and the axis of said intermediate drive shaft, and a spur gear in mesh with said crown gear, whereby said crown gear is operatively connected to said slider in such a way that the rotation of said crown gear which in turn is caused by the rotation of said spur gear causes the axial slidable movement of said slider in said first swinging arm; and the teeth of said crown gear are cut or otherwise formed in the spherical surface of a spherical segment whose center is at the point of intersection between the axis of said intermediate drive shaft and said axis of rotation and are arcuately extended in the median direction of said spherical segment, whereby when said crown gear makes a reciprocal or oscillatory motion in unison with said first swinging arm, the teeth of said crown gear can pass the spaces between the adjacent teeth of said spur gear without any contact with the teeth of the spur gear.

16. A roll feed apparatus as set forth in claim 13, wherein said interlocking device comprises a first swinging arm whose end is rigidly connected to one end of said intermediate drive shaft and which is extended substantially perpendicular to the axis of said intermediate drive shaft and in which is disposed a slider for axial slidable movement, a second swinging arm whose one end is rigidly connected to said rotating sleeve and which is extended in parallel with said first swinging arm, a connecting rod for interconnecting between the other end of said second swinging arm and said slider, a crown gear supported on said first swinging arm in such a way that said crown gear is rotated in unison with said first swinging arm about the axis of said intermediate drive shaft and also rotated about the axis of rotation perpendicular to said axis of said intermediate drive shaft in a plane containing both the axis of said first swinging arm and the axis of said intermediate drive shaft, and a spur gear in mesh with said crown gear, whereby said crown gear is operatively connected to said slider in such a way that the rotation of said crown gear which in turn is caused by the rotation of said spur gear causes the axial slidable movement of said slider in said first swinging arm; and the teeth of said crown gear are cut or otherwise formed in the spherical surface of a spherical segment whose center is at the point of intersection between the axis of said intermediate drive shaft and said axis of rotation and are arcuately extended in the median direction of said spherical segment, whereby when said crown gear makes a reciprocal or oscillatory motion in unison with said first swinging arm, the teeth of said crown gear can pass the spaces between the adjacent teeth of said spur gear without any contact with the teeth of the spur gear.

17. A roll feed apparatus as set forth in claim 1, wherein said interlocking device comprises a first swinging arm whose end is rigidly connected to one end of said intermediate drive shaft and which is extended substantially perpendicular to the axis of said intermediate drive shaft and in which is disposed a slider for axial slidable movement, a second swinging arm whose one end is rigidly connected to said rotating sleeve and which is extended in parallel with said first swinging arm, a connecting rod for interconnecting between the other end of said second swinging arm and said slider, a crown gear supported on said first swinging arm in such a way that said crown gear is rotated in unison with said first swinging arm about the axis of said intermediate drive shaft and also rotated about the axis of rotation perpendicular to said axis of said intermediate drive shaft in a plane containing both the axis of said first swinging arm and the axis of said intermediate drive shaft, and a spur gear in mesh with said crown gear, whereby said crown gear is operatively connected to said slider in such a way that the rotation of said crown gear which in turn is caused by the rotation of said spur gear causes the axial slidable movement of said slider in said first swinging arm; and the teeth of said crown gear are cut or otherwise formed in the spherical surface of a spherical segment whose center is at the point of intersection between the axis of said intermediate drive shaft and sais axis of rotation and are arcuately extended in the median direction of said spherical segment, whereby when said crown gear makes a reciprocal or oscillatory motion in unison with said first swinging arm, the teeth of said crown gear can pass the spaces between the adjacent teeth of said spur gear without any contact with the teeth of the spur gear.

* * * * *